United States Patent [19]

Saurwein

[11] Patent Number: 4,818,194

[45] Date of Patent: Apr. 4, 1989

[54] CHECK VALVE ASSEMBLY FOR FLUID PRESSURE INTENSIFYING APPARATUS

[76] Inventor: Albert C. Saurwein, 5 F St., SE., Auburn, Wash. 98002

[21] Appl. No.: 60,521

[22] Filed: Jun. 11, 1987

[51] Int. Cl.[4] ..... F04B 21/02

[52] U.S. Cl. ..... 417/567; 137/512.5; 417/571

[58] Field of Search ..... 417/560, 567, 571, 569; 137/512.3, 512.5

[56] References Cited

U.S. PATENT DOCUMENTS 3,114,326 12/1963 Yaindl ..... 417/567
3,309,013 3/1967 Bauer ..... 417/567
3,702,624 11/1972 Fries ..... 417/567 X
3,746,483 7/1973 Hindel et al. ..... 137/512.3 X
4,412,792 11/1983 Laborde et al. ..... 417/571 X

FOREIGN PATENT DOCUMENTS 617034 2/1961 Italy ..... 417/567

*Primary Examiner*—Leonard E. Smith
*Attorney, Agent, or Firm*—Harry M. Cross, Jr.

[57] ABSTRACT

A check valve assembly for fluid pressure-intensifying apparatus of the double-acting type is provided. The assembly has an inner low pressure poppet valve member communicable with the high pressure chamber of fluid pressure-intensifying apparatus, and an outer high pressure poppet valve member communicable with a high pressure fluid outlet line. The check valve assembly is designed for service accessibility without having to dismantle the intensifier.

12 Claims, 2 Drawing Sheets

FIG. 3
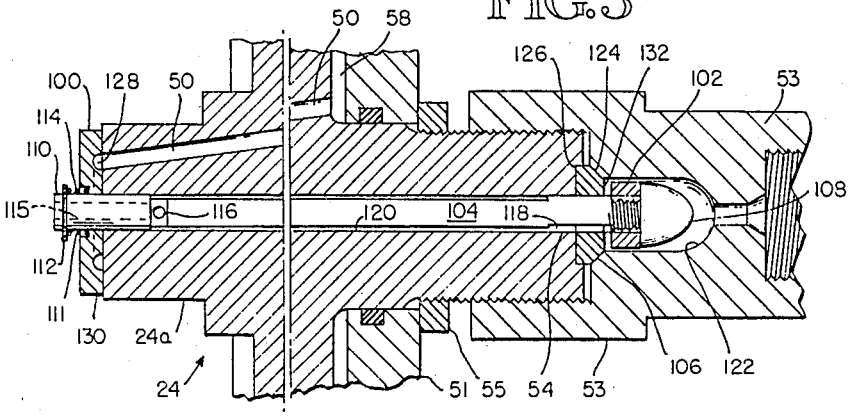
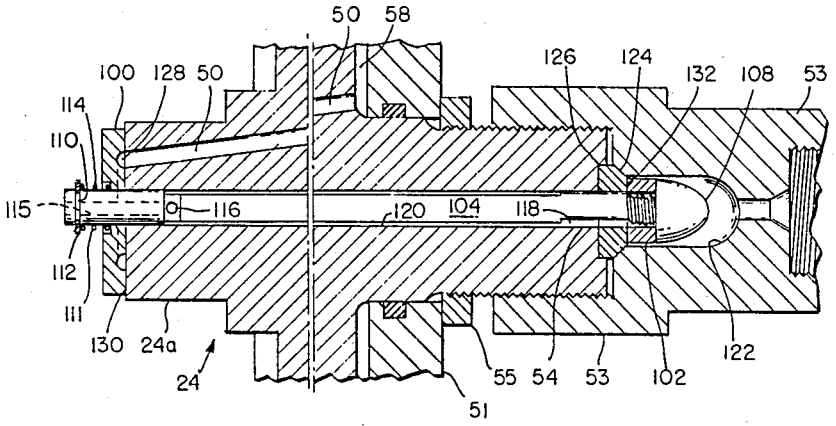
FIG. 4

CHECK VALVE ASSEMBLY FOR FLUID PRESSURE INTENSIFYING APPARATUS

FIELD OF THE INVENTION

This invention relates to high pressure fluid intensifier systems. More particularly, this invention relates to check valve assemblies for controlling fluid flow into and out of the high pressure intensifier chamber.

BACKGROUND OF THE INVENTION

In a typical high pressure fluid intensifier system, hydraulic fluid acts on a reciprocating double-acting, low pressure—high pressure piston assembly to compress water to several thousand psi. The piston assemblies of such systems are exposed to hydraulic fluid pressures on the order of 2,000 psi and to outlet water pressures on the order of 20–60,000 psi. These assemblies must be designed to withstand tremendous pressure fluctuations while at the same time maintain hydraulic fluid/water separation.

The inlet and outlet valve members of the pressurized fluid check valve assembly and their valve seats are severely stressed and corroded. Replacement of the valve members and their seats periodically is difficult because of the attachment of the various members making up the intensifier pressure chambers and piston assembly. Usually, the intensifier must be completely dismantled to reach and repair or replace such internal elements.

SUMMARY OF THE INVENTION

The check valve assembly of the invention is designed to be accessible for service without dismantling the intensifier appurtenant thereto. The high pressure water outlet portion is provided at the outer end of the assembly and is accessible by simply removing a high pressure fluid outlet adapter. Removal of the adapter exposes the high pressure valve element and its seat for service or replacement.

The inner, low pressure end of the assembly requires service less often. To access the low pressure end, the valve assembly must be removed from the intensifier. To facilitate the removal of the check valve assembly, the assembly is designed to be secured to the intensifier by an end retainer ring that positions the assembly in fluid communication with the intensifier high pressure chamber. By removal of the retainer ring, the check valve assembly can be removed without dismantling the the intensifier.

BRIEF DESCRIPTION OF THE DRAWINGS

FIG. 3 is similar to FIG. 2 with the high pressure outlet depicted in a closed condition;

DESCRIPTION OF THE INVENTION

Figure 1:
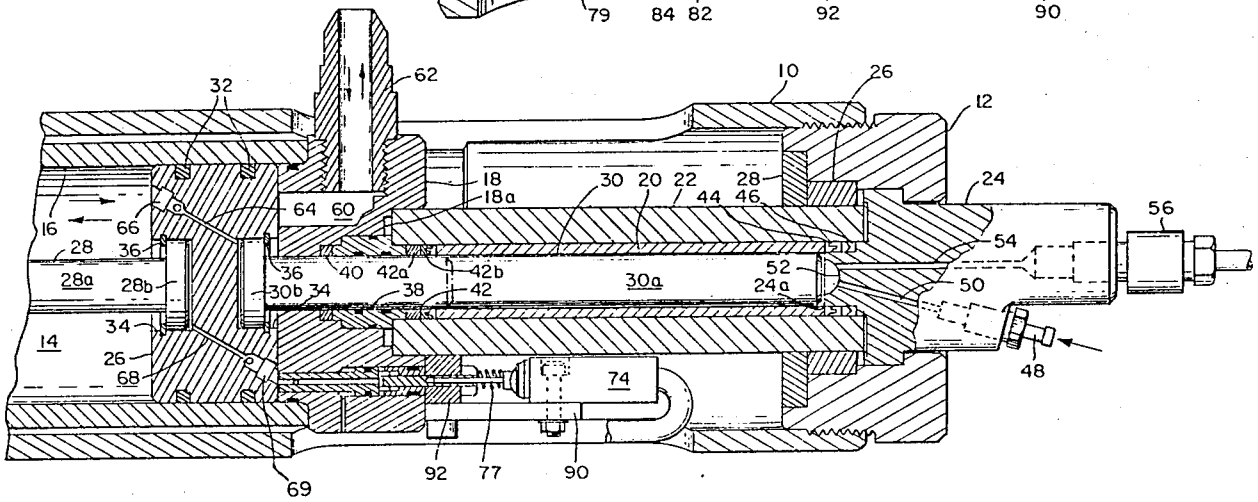
FIG. 1 is a front elevation of the right half of the intensifier of this invention in partial cross section.

An intensifier arrangement utilizes hydraulic fluid (oil) to drive a high pressure—low pressure piston assembly to produce a high pressure water flow. The intensifier shown in FIG. 1 is double-acting. It comprises a housing 10 in the form of an elongated steel cylinder. One half, the right half, is shown in FIG. 1. The left half is a duplicate. Each end of the housing mounts an end retainer ring12, the end of housing 10 being internally threaded to mate with external threads on end retainer ring 12 as shown. Within housing 10, a low pressure chamber 14 is provided by a steel cylinder 16 fitted onto a cylindrical end cap 18 at each end (the right hand cap being shown; the left hand end cap is an opposite hand duplicate). Also within housing 10, a left hand and a right hand high pressure chamber are provided (the right hand high pressure chamber 20 being shown; the left hand high pressure chamber is a duplicate), each by an elongated steel barrel cylinder 22 fitted at its inner end into end cap 18 and at its outer end onto a valve body 24 of an inlet/outlet water check valve assembly. End retainer 12, acting through valve body 24, centers the outer end of cylinder 22.

The outer surface of end cap 18 conforms to the inner surface of housing cylinder 10, with a small allowance for a slip-fit clearance. Tightening the end retainers 12 places the pressure chamber elements in longitudinal compression and the housing cylinder 10 in longitudinal tension. When one or both end retainers 12 are removed, however, these elements may be removed from the housing in a very expeditious manner. The low pressure and high pressure cylinders, 16 and 22, are mounted in axial alignment with the housing cylinder 10 by the end caps 18 and the retainer rings 12. Because of the relative dimensions of the elements thus far described, the pressure chamber elements are confined against any lateral or longitudinal movement.

The low pressure—high pressure piston assembly comprises a low pressure piston 26 and left and right hand high pressure pistons 28 and 30. The low pressure piston is a cylindrical disk contained within low pressure chamber 14. Its outer surface conforms to the inner surface of low pressure cylinder 16, with a small allowance for a slip-fit clearance, and mounts appropriate hydraulic pressure seals 32 to seal one side of low pressure chamber 14 from the other. The high pressure pistons are connected to opposite faces of the low pressure piston 26 and extended through the respective cylinder block 18 into high pressure chamber sleeve 20.

The outer end of high pressure cylinder 22 fits over a pilot or shoulder that protrudes from the check valve body 24. Valve body 24 is machined to provide a cylindrical pilot **24*a* for that purpose. The end of the pilot is machined to provide a smaller cylindrical end surface as a seat for a high pressure static seal group 44. The stepped transition between the high pressure cylinder-mounting pilot and the high pressure seal seat provides a metal back up for seal group 44. The end diameter of pilot 24*a* corresponds to the diameter of high pressure piston rod 30** as shown.

As high pressure piston rod 30 is retracted from the position shown, low pressure water is drawn into high pressure chamber 20 through inlet passage 50 in inlet/-outlet water check valve assembly 25. When piston rod 30 is driven back to the position shown, water is compressed to a high pressure and then forced out through outlet passage 54 in check valve assembly 25. Water flow into and out of high pressure chamber 20 is controlled by a water pressure-influenced poppet-type check valve mechanism 52.

Figure 2:
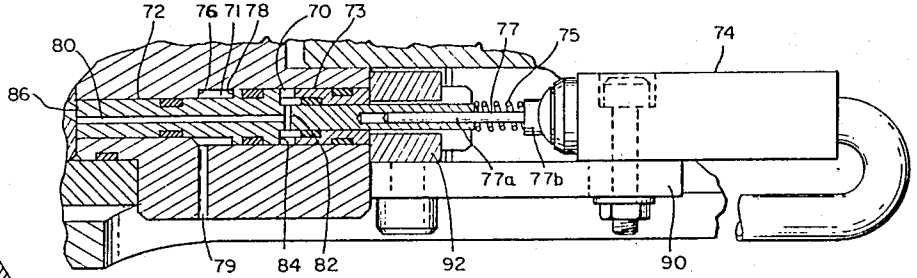
FIG. 2 is an enlarged cross section of the inlet/outlet valve shown in FIG. 1 with the high pressure outlet depicted in an open condition.

Inlet/outlet water check valve assembly 25 comprises valve body 24, low pressure water inlet manifold 51 communicating with low pressure water inlet passage 50, poppet check valve mechanism 52, high pressure outlet water line adapter 53 communicating with high pressure water outlet passage 54, and manifold lock nut 55 receiving manifold 51 to valve body 24. The outer end of valve body 24 is externally threaded and lock nut 55 screwed thereon to position manifold 51. Low pressure inlet water line 56 is attached to manifold 51 and high pressure outlet water line 57 is attached to adapter 53. The inner face of manifold 51 is machined to provide an annulus 58 for distribution of inlet water from inlet line 56 to inlet passage 50.

the check valve mechanism 52, as shown in enlarged detail in FIGS. 2 and 3, comprises an inlet poppet 100, an outlet poppet 102, a valve stem 104 connecting the two poppets, a high pressure poppet seat 106, and an enlarged abutment end 108 of stem 104 to retain and secure outlet poppet 102. The stem 104 extends through high pressure water outlet passage 54 and mounts the poppets at opposite ends. The inner end or head 110 of stem 104 is machined to provide an inner annular groove 111 for a return coil spring 114 and a spring retainer "E" ring clip 112 for retaining poppet 100. The mechanism is so arranged that inlet poppet 100 seats on the inner end surface of pilot **24*a* to seal low pressure water inlet passage 50, and outlet poppet 102 seats on high pressure seat element 106 to seal high pressure water outlet 54. Inlet poppet 100 is slidably mounted by and is axially moveable on the inner end of stem 104. Outlet poppet 102 is slidably mounted by and is axially movable on the outer end of stem 102 and retained thereon by enlarged stem end 108. The length of stem 104 between head 110 and the end 108 is sufficient to enable outlet poppet 102 to be unseated (as shown in FIG. 2) when high pressure water bears against head 110 and shifts stem 104 as far outward as head 110 permits. Head 110 and the inner end portion of stem 104 are axially counterbored to provide a passage 115 that communicates with one or more diametric passages 116 cross-bored in stem 104. The outer end of stem 104, just inward of outlet poppet 102, is shaped to provide a passage 118 between that portion of stem 104 and the bore through valve body 24 high pressure water outlet passage 54. The intermediate length of stem 104 is shaped to provide a passage 120 between that portion of stem 104 and the bore through valve body 24, which bore provides high pressure water outlet passage 54. Passage 120 interconnects cross-bore 116 and passage 118 to enable high pressure water to pass through water outlet passage 54 when outlet poppet 102 is lifted from its seat 106 to the position shown in FIG. 2. Adapter 53 is provided with an inner cavity 122 that extends from seat element 106 to the high pressure outlet water line 57 and encloses outlet poppet 102 and enlarged stem 108 with space to spare for high pressure water travel around poppet 102 and end 108 from passage 54 to outlet line 57. Adapter 53 has a beveled annular surface 124 at the base of cavity 122. Surface 124 bears against a corresponding beveled surface on seat element 106 to secure seat 106 in a recess 126 provided therefor in the outer end of valve body 24, when adapter 53 is screwed onto valve body 24. Inlet poppet 100 is provided with an annular recess 128 that communicates with inlet water passage 50 when inlet poppet 100 is seated against the end surface 130 of stub 24*a*. Spring 114 seats in a depression machined in the adjacent face of inlet poppet 100**.

When water has been compressed by the high pressure piston rod to a pressure sufficient to overcome the spring force of spring 114, valve stem 105 is shifted to the position shown in FIG. 2 by water pressure acting on valve stem head 110. Prior to that point in time, water pressure acting on inlet poppet 100 would have closed inlet poppet 100 against surface 130 on valve body plug **24*a* to seal off low pressure inlet water passage 50. With valve stem 104 positioned as shown in FIG. 2, outlet poppet is raised from its seat element 106 and high pressure water is forced by the high pressure piston rod through passages 114, 116, 120 118 into cavity 122 and out through line 57. When the high pressure piston rod reaches the end of its pressurization cycle, reverses, and begins to retract, the spring force of spring 110 and the reverse force of high pressure water in line 57 forces valve stem 104 to the position shown in FIG. 3, seating outlet poppet 102 against seat element 114 to close off the high pressure outlet to line 57. As the high pressure piston rod is retracted, the force of low pressure water from passage 50, acting concentrically within annular recess 128 on inlet poppet, lifts poppet 110 from its seat 130 on pilot 24*a* and flows around poppet 100 into the high pressure chamber. The spring force of spring 114 is sufficiently small that the force of low pressure water acting on the opposite side of poppet 100 will shift poppet 100 along valve stem 104 from the position shown in FIG. 3 toward valve stem head 110 to release water from passage 50 into the high pressure chamber. The travel length of poppet 100 is limited by spring clip 112**.

Of the two poppet sealing surfaces, the sealing surface 132 associated with outlet poppet 102 incurs much more severe stress. Consequently, seat element 124 is provided as a replaceable element. Moreover, the mating surfaces of poppet 102 and seat element 124 undergo wear, necessitating that these surfaces must be periodically polished to avoid high pressure water back leakage from line 57. The configuration and arrangement of adaptor 53 permits convenient handling of these matters. Without dislodging or disassembly of any part of the rest of the system, adaptor 53 can be unscrewed and removed from valve body 24 to expose seat element 106, poppet 102 and enlarged stem end 108. Poppet 102 can be removed to permit polishing of the sealing surfaces, replacement of the seat element 106 or poppet 102, or whatever else may be required in connection with the high pressure outlet check valve mechanism by removing the assembly and disconnecting clip 112. High pressure outlet line 57, typically a stainless steel tubing, is preferably coiled in the vicinity of adapter 53 and screwed thereto by mans of a coupling that permits adapter 53 to be turned relative to line 57. The resiliency of the coiled tubing permits the removal of adapter 53 away from the valve body 24 for working on the exposed mechanism.

While a preferred embodiment of an intensifier check valve assembly, made in accordance with the principles of the present invention, has been described and illustrated, certain changes may be made without departing from the scope of the invention.

What is claimed is:

1. Fluid inlet-outlet means for mounting in fluid communication with a high pressure chamber of a reciprocating piston cylinder, said fluid inlet-outlet means comprising a check valve body fitable to said high pressure chamber, said valve body being provided with a longitudinal axial fluid passage opening at one end for fluid communication with an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end for fluid communication with an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for said valve body comprising an elongated valve stem extended through said axial fluid passage and extending out from the inner end of said valve stem and extending into the coupling cavity at the outer end of said valve stem and being so configured as to enable high pressure fluid to pass from said inner end through said axial fluid passage into said coupling cavity, and further comprising an inlet poppet slidably mounted on the inner end of said valve stem and being so configured as to overlay and seal off the inlet fluid passage opening when the force exerted by fluid from a high pressure fluid chamber exceeds the force exerted by inlet fluid within said inlet fluid passage; and outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

2. Fluid inlet-outlet means for mounting in fluid communication with a high pressure chamber of a reciprocating piston cylinder, said fluid inlet-outlet means comprising a check valve body fitable to said high pressure chamber, said valve body being provided with a longitudinal axial fluid passage opening at one end fluid communication with an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end for fluid communication with an adjacent high pressure piston chamber and opening at the other end into the adjacent low pressure fluid inlet distributor; a valve mechanism for said valve body comprising an elongated valve stem extended through said axial fluid passage and extending out from the inner end of said valve stem and extending out from the coupling cavity at the outer end of said valve stem and being so configured as to enable high pressure fluid to pass from said inner end through said axial fluid passage into said coupling cavity, and further comprising an inlet poppet slidably mounted on the inner end of said valve stem and being so configured as to overlay and seal off the inlet fluid passage opening when the force exerted by fluid from a high pressure fluid chamber exceeds the force exerted by inlet fluid within said inlet fluid passage; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid, said outlet line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

3. Fluid inlet-outlet means for mounting in fluid communication with a high pressure chamber of a reciprocating piston cylinder, said fluid inlet-outlet means comprising a check valve body fitable to said high pressure chamber and, said valve body being provided with a longitudinal axial fluid passage opening at one end for fluid communication with an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end for fluid communication with an adjacent high pressure piston chamber and opening at the other end into the adjacent low pressure fluid inlet distributor; a valve mechanism for said valve body comprising an elongated valve stem extended through said axial fluid passage and extending out from the inner end of said valve stem and extending into the coupling cavity at the outer end of said valve stem and being so configured as to enable high pressure fluid to pass from inner end through said axial fluid passage into said coupling cavity, and further comprising an inlet poppet slidably mounted on the inner end of said valve stem and being so configured as to overlay and seal off the inlet fluid passage opening when the force exerted by fluid from a high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portion of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

4. Fluid inlet-outlet means for mounting in fluid communication with a high pressure chamber of a reciprocating piston cylinder, said fluid inlet-outlet means comprising a check valve body fitable to said high pressure chamber, with said valve body being provided with a longitudinal axial fluid passage opening at one end for fluid communication with an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end for fluid communication with an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for said valve body an elongated valve stem extended through said axial fluid passage extending out from the inner end of said valve stem and extending into the coupling cavity at the outer end of said valve stem and being so configured as to enable high pressure fluid to pass from said inner end through said axial fluid passage into said coupling cavity, and further comprising an inlet poppet slidably mounted on the inner end of said valve stem and being so configured as to overlay and seal off the inlet fluid passage opening when the force exerted by fluid from a high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portion of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to each valve body, each outlet line coupling being provided with an internal coupling passage within which said valve stem extends as aforesaid; said outlet line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to each fluid inlet distributor; and valve body mounting means compressively fitting said valve body to the adjacent high pressure chamber and being configured whereby fluid inlet and discharge through said valve body is independent of the valve body mounting.

5. In a fluid pressure-intensifying apparatus which comprises a low pressure—high pressure cylinder means providing a cylindrical low pressure chamber and at least one elongated cylindrical high pressure chamber, the high pressure chamber extending from one end of said low pressure chamber; low pressure—high pressure piston means having a double acting low pressure piston section mounted for reciprocal movement in said low pressure chamber, and having at least one elongated high pressure piston section connected to said low pressure piston section and extending from said low pressure chamber into an adjacent high pressure chamber for reciprocal movement therein; the improvement comprising: fluid inlet-outlet means in fluid communication with said high pressure chamber, said fluid inlet-outlet means comprising a check valve body fitted to the outer end of said high pressure chamber and so constructed and arranged to be compressively fitted to said high pressure chamber, said valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end into an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for said valve body comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

6. In a fluid pressure-intensifying apparatus which comprises a low pressure—high pressure cylinder means providing a cylindrical low pressure chamber and at least one elongated cylindrical high pressure chamber, the high pressure chamber extending from one end of said low pressure chamber; low pressure—high pressure piston means having a double acting low pressure piston section mounted for reciprocal movement in said low pressure chamber, and having at least one elongated high pressure piston section connected to said low pressure piston section and extending from said low pressure chamber into an adjacent high pressure chamber for reciprocal movement therein; the improvement comprising: fluid inlet-outlet means in fluid communication with said high pressure chamber, said fluid inlet-outlet means comprising a check valve body fitted to the outer end of said high pressure chamber and so constructed and arranged to be compressively fitted to said high pressure chamber, said valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end into an adjacent high pressure piston chamber and opening at the other end into the adjacent low pressure fluid inlet distributor; a valve mechanism for said valve body comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid, said outlet line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

7. In a fluid pressure-intensifying apparatus which comprises a low pressure—high pressure cylinder means providing a cylindrical low pressure chamber and at least one elongated cylindrical high pressure chamber, the high pressure chamber extending from one end of said low pressure chamber; low pressure—high pressure piston means having a double acting low pressure piston section mounted for reciprocal movement in said low pressure chamber, and having at least one elongated high pressure piston section connected to said low pressure piston section and extending from said low pressure chamber into an adjacent high pressure chamber for reciprocal movement therein; the improvement comprising: fluid inlet-outlet means in fluid communication with said high pressure chamber, said fluid inlet-outlet means comprising a check valve body fitted to the outer end of said high pressure chamber and so constructed and arranged to be compressively fitted to said high pressure chamber, said valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end into an adjacent high pressure piston chamber and opening at the other end into the adjacent low pressure fluid inlet distributor; a valve mechanism for said valve body comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portion of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to said valve body, said outlet line coupling being provided with an internal coupling passage within which said valve stem extends as aforesaid; a low pressure fluid inlet line coupling externally mounted to said fluid inlet distributor; and valve body mounting means compressively fitting said valve body to the adjacent high pressure chamber and being configured whereby fluid inlet and discharge through said valve body is independent of the valve body mounting.

8. In a fluid pressure-intensifying apparatus which comprises a low pressure—high pressure cylinder means providing a cylindrical low pressure chamber and at least one elongated cylindrical high pressure chamber, the high pressure chamber extending from one end of said low pressure chamber; low pressure—high pressure piston means having a double acting low pressure piston section mounted for reciprocal movement in said low pressure chamber, and having at least one high pressure piston section connected to said low pressure piston section and extending from said low pressure chamber into an adjacent high pressure chamber for reciprocal movement therein; the improvement comprising: fluid inlet-outlet means in fluid communication with said high pressure chamber, said fluid inlet-outlet means comprising a check valve body fitted to the outer end of said high pressure chamber and so constructed and arranged to be compressively fitted to said high pressure chambers, with said valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by said valve body, with said valve body being provided with an elongated inlet fluid passage opening at one end into an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for said valve body an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portion of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to each valve body, each outlet line coupling being provided with an internal coupling passage within which said valve stem extends as aforesaid; said outlet line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to each fluid inlet distributor; and valve body mounting means compressively fitting said valve body to the adjacent high pressure chamber and being configured whereby fluid inlet and discharge through said valve body is independent of the valve body mounting.

9. In a fluid pressure-intensifying apparatus which comprises a low pressure—high pressure cylinder means providing a cylindrical low pressure chamber and a pair of elongated cylindrical high pressure chambers, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pressure chamber for reciprocal movement therein; the improvement comprising: fluid inlet-outlet means in fluid communication with said high pressure chambers to simultaneously introduce fluid to be pressurized to one high pressure chamber and withdraw pressurized fluid from the other high pressure chamber, said fluid inlet-outlet means comprising a pair of check valve bodies each fitted to the outer end of one of said high pressure chambers and so constructed and arranged to be compressively fitted to said high pressure chambers, with each valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by each valve body, with each valve body being provided with an elongated inlet fluid passage opening at one end into an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for each valve body, each such valve mechanism comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to each valve body, each outlet line coupling being provided with an internal coupling passage within which said valve stem extends as aforesaid; a low pressure fluid inlet line coupling externally mounted to each fluid inlet distributor; and valve body mounting means compressively fitting said valve bodies to their respectively-adjacent high pressure chambers and being configured whereby fluid inlet and discharge through each valve body is independent of the valve body mounting.

10. In a fluid pressure-intensifying apparatus which comprises a low pressure—high pressure cylinder means providing a cylindrical low pressure chamber and a pair of elongated cylindrical high pressure chambers, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pressure chamber for reciprocal movement therein; the improvement comprising: fluid inlet-outlet means in fluid communication with said high pressure chambers to simultaneously introduce fluid to be pressurized to one high pressure chamber and withdraw pressurized fluid from the other high pressure chamber, said fluid inlet-outlet means comprising a pair of check valve bodies each fitted to the outer end of one of said high pressure chambers and so constructed and arranged to be compressively fitted to said high pressure chambers, with each valve body being provided with a longitudinal axial fluid passage opening at one end into an adjacent high pressure piston chamber and opening at the other end into a cavity provided inan adjacent high pressure outlet line coupling; a low pressure fluid inlet distributor mounted by each valve body, with each valve body being provided with an elongated inlet fluid passage opening at one end into an adjacent high pressure piston chamber and opening at the other end into the adjacent low pressure fluid inlet distributor; a valve mechanism for each valve body, each such valve mechanism comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to each valve body, each outlet line coupling being provided with an internal coupling passage within which said valve stem extends as aforesaid, said outlet line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to each fluid inlet distributor; and valve body mounting means compressively fitting said valve bodies to their respectively-adjacent high pressure chambers and being configured whereby fluid inlet and discharge through each valve body is independent of the valve body mounting.

11. In a fluid pressure-intensifying apparatus which comprises a low pressure—high pressure cylinder means providing a cylindrical low pressure chamber and a pair of elongated cylindrical high pressure chambers, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pressure chamber for reciprocal movement therein; the improvement comprising: fluid inlet-outlet means in fluid communication with said high pressure chambers to simultaneously introduce fluid to be pressurized to one high pressure chamber and withdraw pressurized fluid from the other high pressure chamber, said fluid inlet-outlet means comprising a pair of check valve bodies each fitted to the outer end of one of said high pressure chambers and so constructed and arranged to be compressively fitted to said high pressure chambers, with each valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by each valve body, with each valve body being provided with an elongated inlet fluid passage opening at one end into an adjacent high pressure piston chamber and opening at the other end into the adjacent low pressure fluid inlet distributor; a valve mechanism for each valve body, each such valve mechanism comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portion of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pssure fluid outlet line coupling externally mounted to each valve body, each outlet line coupling being provided with an internal coupling passage within which said valve stem extends as aforesaid; a low pressure fluid inlet line coupling externally mounted to each fluid inlet distributor; and valve body mounting means compressively fitting said valve bodies to their respectively-adjacent high pressure chambers and being configured whereby fluid inlet and discharge through each valve body is independent of the valve body mounting.

12. In a fluid pressure-intensifying apparatus which comprises a low pressure—high pressure cylinder means providing a cylindrical low pressure chamber and a pair of elongated cylindrical high pressure chambers, the high pressure chambers extending from opposite ends of said low pressure chamber; low pressure—high pressure piston means having a double acting low pressure piston section mounted for reciprocal movement in said low pressure chamber, and having a pair of elongated high pressure piston sections connected to opposite sides of said low pressure piston section and extending from said low pressure chamber into an adjacent high pessure chamber for reciprocal movement therein; the improvement comprising: fluid inlet-outlet means in fluid communication with said high pressure chambers to simultaneously introduce fluid to be pressurized to one high pressure chamber and withdraw pressurized fluid from the other high pressure chamber, said fluid inlet-outlet means comprising a pair of check valve bodies each fitted to the outer end of one of said high pressure chambers and so constructed and arranged to be compressively fitted to said high pressure chambers, with each valve body being provided with a longitudinal axial fluid passage opening at one end into an adjacent high pressure piston chamber and opening at the other end into a cavity provided in an adjacent high pressure outlet line coupling; a low pressure fluid inlet distributor mounted by each valve body, with each valve body being provided with an elongated inlet fluid passage opening at one end into an adjacent high pressure piston chamber and opening at the other end into the adjacent low pressure fluid inlet distributor, said inlet fluid passage extending acutely outward through said valve body from its inner end to its outer end to an annular land provided in the exterior of said valve body, and said inlet distributor having an annular configuration and being axially fitted around said valve body and sealed against said annular land in fluid communication with said inlet fluid passage; distributor sealing means that fluid-tightly secures said inlet distributor to said valve body annular land; a valve mechanism for each valve body, each such valve mechanism comprising an elongated valve stem extended through said axial fluid passage into the high pressure chamber at the inner end of said valve stem and the coupling cavity at the outer end of said valve stem and being so configured as to enable high pressure fluid to pass from said high pressure chamber through said axial fluid passage into said coupling cavity, and further comprising an inlet poppet slidably mounted on the inner end of said valve stem within said high pressure chamber and being so configured as to overlay and seal off the inlet fluid passage opening into said high pressure fluid chamber when the force exerted by fluid in said high pressure fluid chamber exceeds the force exerted by inlet fluid within said inlet fluid passage; said valve stem containing an inner axial passage extending from its inner end partially therethrough, a transverse passage providing fluid communication with said inner axial passage and said axial fluid passage through said valve body, and an outer configuration enabling fluid to pass exteriorily of said valve stem from said transverse passage to said coupling cavity; said inlet poppet comprising a solid disk contained around the inner portin of its valve stem; an outlet seat element exposed to said coupling cavity and through which said valve stem extends, an outlet poppet mounted by said valve stem outer end within said coupling cavity and so configured as to be able to seat against said outlet seat element to seal said axial fluid passage from high pressure fluid backflow out of said coupling cavity; a high pressure fluid outlet line coupling externally mounted to each valve body, each outlet line coupling being provided with an internal coupling passage within which said valve stem extends as aforesaid; said outline line coupling being positioned axially of said valve body and threadedly fastened to said valve body outer end, said outlet seat element being seated in the outer end of said valve body whereby threadedly disengaging said outlet line coupling will expose said outlet seat element for service and replacement; a low pressure fluid inlet line coupling externally mounted to each fluid inlet distributor; and valve body mounting means compressively fitting said valve bodies to their respectively-adjacent high pressure chambers and being configured whereby fluid inlet and discharge through each valve body is independent of the valve body mounting.

* * * * *